US007607244B2

(12) United States Patent
Hishida

(10) Patent No.: US 7,607,244 B2
(45) Date of Patent: Oct. 27, 2009

(54) SNOW-PLOWING APPARATUS

(75) Inventor: Tadashi Hishida, Sakai (JP)

(73) Assignee: VIV Engineering Inc., Sakai-shi (JP)

( * ) Notice: Subject to any disclaimer, the term of this patent is extended or adjusted under 35 U.S.C. 154(b) by 1 day.

(21) Appl. No.: 11/907,032

(22) Filed: Oct. 9, 2007

(65) Prior Publication Data

US 2009/0090033 A1 Apr. 9, 2009

(51) Int. Cl.
*E01H 5/09* (2006.01)
*E01H 5/02* (2006.01)

(52) U.S. Cl. ..... 37/248; 37/241; 37/265; 56/12.7

(58) Field of Classification Search ..... 37/241–244, 37/248, 265; 56/12.7
See application file for complete search history.

(56) References Cited

U.S. PATENT DOCUMENTS 2,687,683 A * 8/1954 Chattin ..... 172/552
2,695,071 A * 11/1954 Hupp ..... 180/19.1
2,714,772 A * 8/1955 Erickson ..... 37/248
2,736,350 A * 2/1956 Hill et al. ..... 30/379
2,787,107 A * 4/1957 Strasel ..... 56/16.9
2,993,321 A * 7/1961 Hester ..... 56/16.9
3,123,962 A * 3/1964 Hester ..... 56/16.9
3,286,376 A * 11/1966 Wildes ..... 37/243
3,673,776 A * 7/1972 Smith ..... 56/16.9
3,774,321 A * 11/1973 David ..... 37/243
3,882,615 A * 5/1975 Williams ..... 37/243
4,064,679 A * 12/1977 Spinner ..... 56/2
4,255,880 A * 3/1981 McMickle et al. ..... 37/259
4,268,964 A * 5/1981 Moore ..... 30/276
4,286,675 A * 9/1981 Tuggle ..... 173/213
4,295,285 A * 10/1981 Stevens ..... 37/246
4,308,676 A * 1/1982 Doane ..... 37/243
4,329,792 A * 5/1982 Berner ..... 37/246
4,365,430 A * 12/1982 Myerly ..... 37/244
4,378,644 A * 4/1983 Tuggle et al. ..... 37/244
4,403,433 A * 9/1983 Smith ..... 37/243
4,446,679 A * 5/1984 Thomas ..... 56/2
4,597,203 A * 7/1986 Middleton ..... 37/241
4,654,971 A * 4/1987 Fettes et al. ..... 30/383

(Continued)

FOREIGN PATENT DOCUMENTS

JP 2005-226336 8/2005

*Primary Examiner*—Thomas A Beach
(74) *Attorney, Agent, or Firm*—Kratz, Quintos & Hanson, LLP

(57) ABSTRACT

A snow-plowing apparatus provided with a snow-removing member detachably attached to an end of a holding rod of a hand-pushed mower, in which an engine and a wheel are attached to a frame, having a detachable rotation transmitting portion, to which a mowing blade is attached and rotational driving force of an engine is transmitted, on the end of the holding rod extending from the engine forward and downward. The snow-removing member is provided with a snowplow rotating body rotated around a horizontal axis through the rotation transmitting portion to plow and shoot the snow. The snowplow rotating body is composed of three short rotating bodies. Each of the short rotating bodies has four snowplowing blades disposed in peripheral direction with a predetermined pitch. And, the snowplow rotating body is composed of the three short rotating bodies mounted on a shaft body as the snow-plowing blades are dislocated one another in the peripheral direction.

8 Claims, 11 Drawing Sheets

U.S. PATENT DOCUMENTS 4,733,471 A * 3/1988 Rahe ..... 30/276
4,884,340 A * 12/1989 Newman ..... 30/122
4,936,886 A * 6/1990 Quillen ..... 56/16.7
4,972,589 A * 11/1990 Povleski ..... 30/500
5,013,282 A * 5/1991 Keller ..... 464/172
5,052,135 A * 10/1991 Fontaine ..... 37/243
5,161,318 A * 11/1992 Bergman et al. ..... 37/233
5,522,162 A * 6/1996 Allison ..... 37/242
5,603,173 A * 2/1997 Brazell ..... 37/244
5,850,882 A * 12/1998 Link ..... 172/41
5,970,692 A * 10/1999 Foster ..... 56/12.1
6,006,434 A * 12/1999 Templeton et al. ..... 30/296.1
6,345,489 B1 * 2/2002 Everts et al. ..... 56/12.7
6,643,958 B1 * 11/2003 Krejci ..... 37/223
6,643,959 B2 * 11/2003 Jolliff et al. ..... 37/244
6,651,347 B2 * 11/2003 Uhl ..... 30/383
6,865,868 B2 * 3/2005 Moshi ..... 56/2
2002/0124540 A1 * 9/2002 Everts et al. ..... 56/12.7
2003/0079455 A1 * 5/2003 Suchdev et al. ..... 56/16.9
2006/0096135 A1 * 5/2006 Shaffer et al. ..... 37/244
2006/0096136 A1 * 5/2006 Shaffer et al. ..... 37/244

* cited by examiner

SNOW-PLOWING APPARATUS

BACKGROUND OF THE INVENTION

1. Field of the Invention

This invention relates to a snow-plowing apparatus.

2. Description of the Related Art

In a conventional snow-plowing apparatus, a housing opening forward for snow shooting is attached to a front part of a body on which an engine is mounted, an auger for gathering snow rotated around a horizontal axis by rotational driving force of the engine is disposed in front of the housing as to be surrounded, and a blower to blow away the snow gathered on a center portion by the rotation of the auger through a chute is provided (refer to Japanese Patent Provisional Publication No. 2005-226336 for example).

In this conventional snow-plowing apparatus, very high torque is loaded to a shaft connected to the engine, very high stress is loaded onto the engine, and defects tend to be generated because the gathering work of the snow on the center portion by the auger and the snow shooting work by the blower are simultaneously conducted by rotating both of the auger and the blower by the driving force of one engine. And, cost is caused because a high-power engine is necessary. Further, this snow-plowing apparatus is exclusively for snow-plowing and the apparatus including the engine can not be utilized in other seasons than winter.

It is therefore an object of the present invention to provide a snow-plowing apparatus which can plow the snow without high stress on the engine, and by use of a machine for other purposes than snow-plowing.

BRIEF DESCRIPTION OF THE DRAWINGS

The present invention will be described with reference to the accompanying drawings in which.

DESCRIPTION OF THE PREFERRED EMBODIMENTS

Preferred embodiments of the present invention will now be described with reference to the accompanying drawings.

Figure 1:
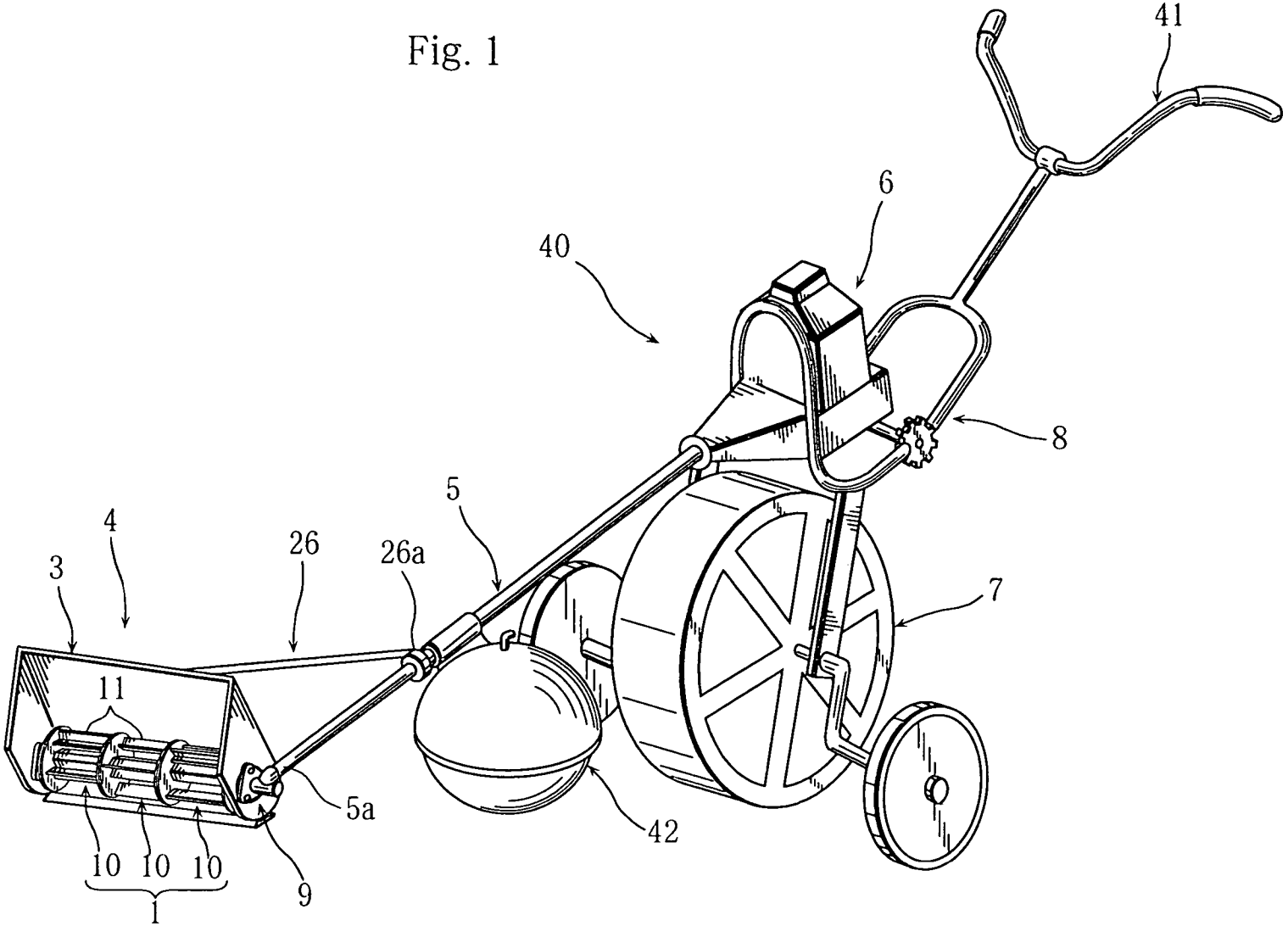
FIG. 1 is a perspective view showing an embodiment of a snow-plowing apparatus relating to the present invention.
Figure 2:
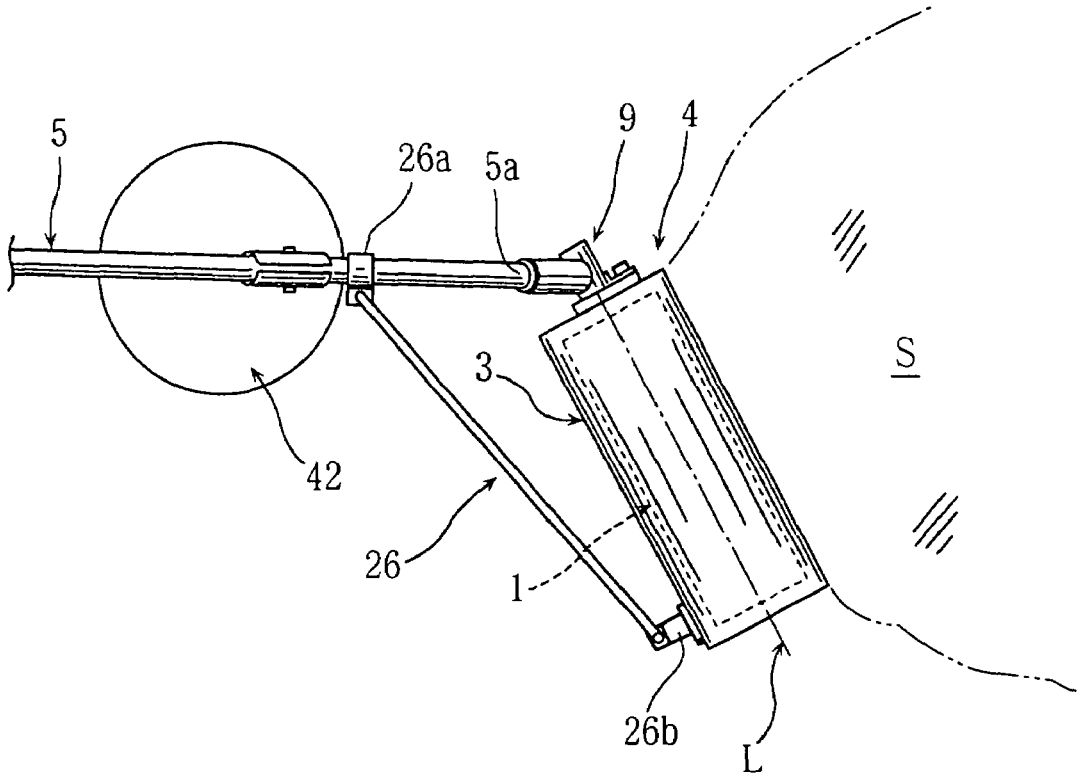
FIG. 2 is a top view of a principal portion.
Figure 3:
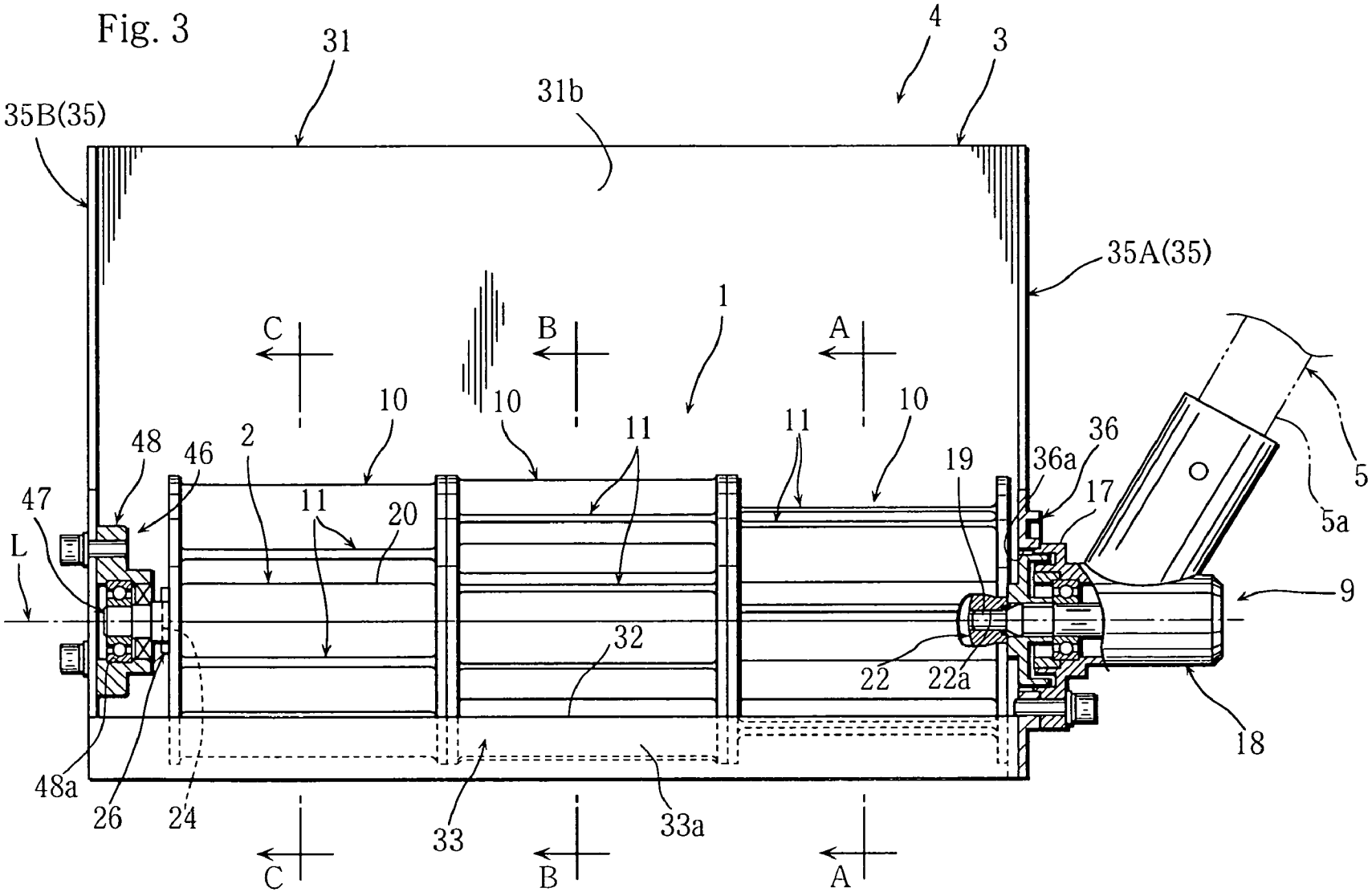
FIG. 3 is a front view of a principal portion.
Figure 4:
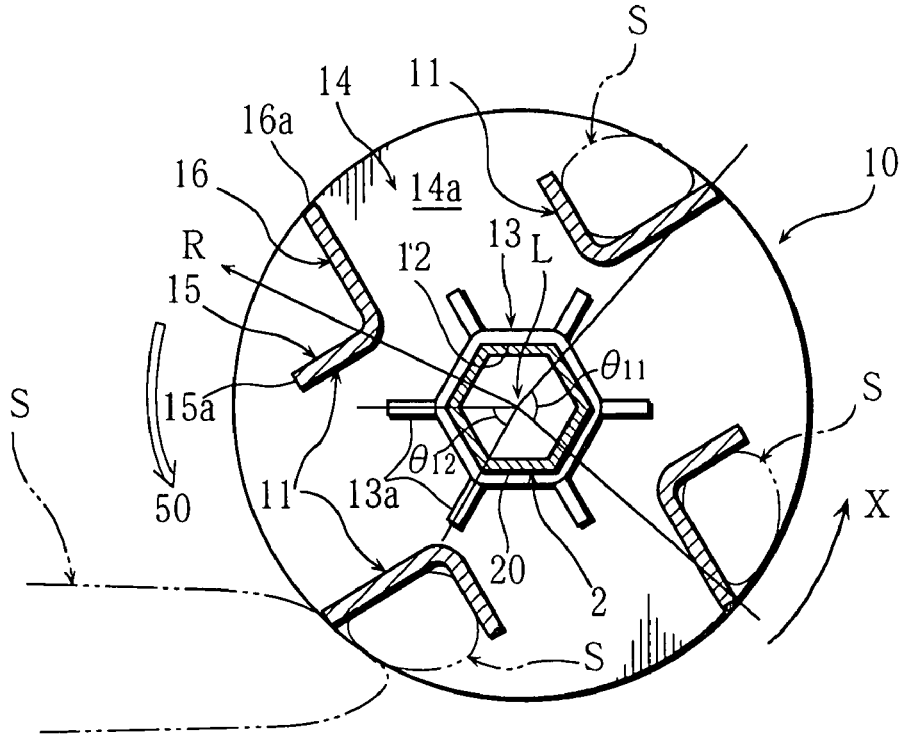
FIG. 4 is a cross-sectional view at A-A line of FIG. 3.
Figure 5:
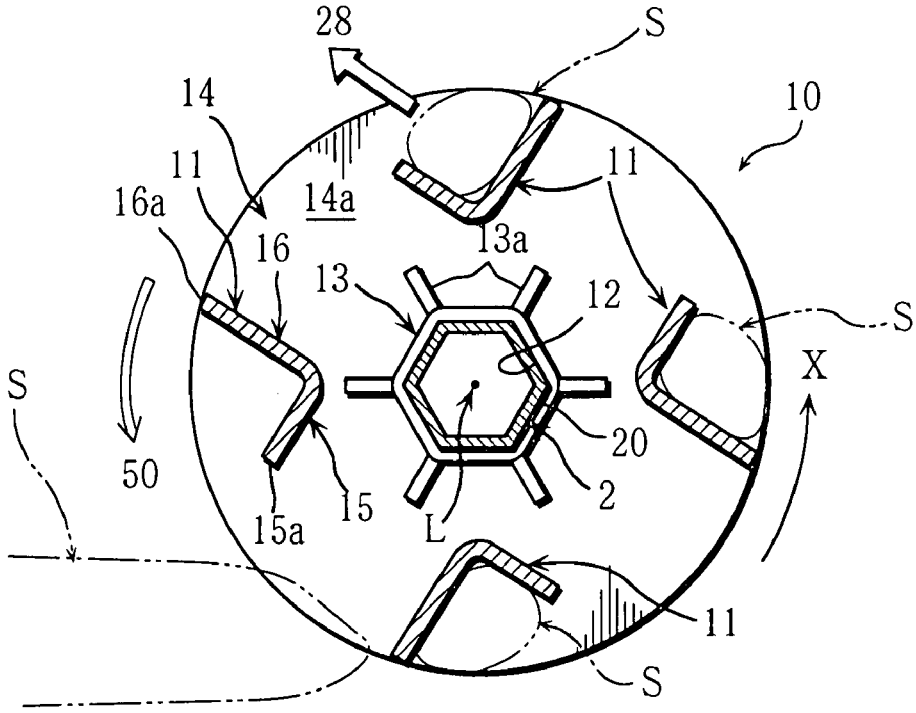
FIG. 5 is a cross-sectional view at B-B line of FIG. 3.
Figure 6:
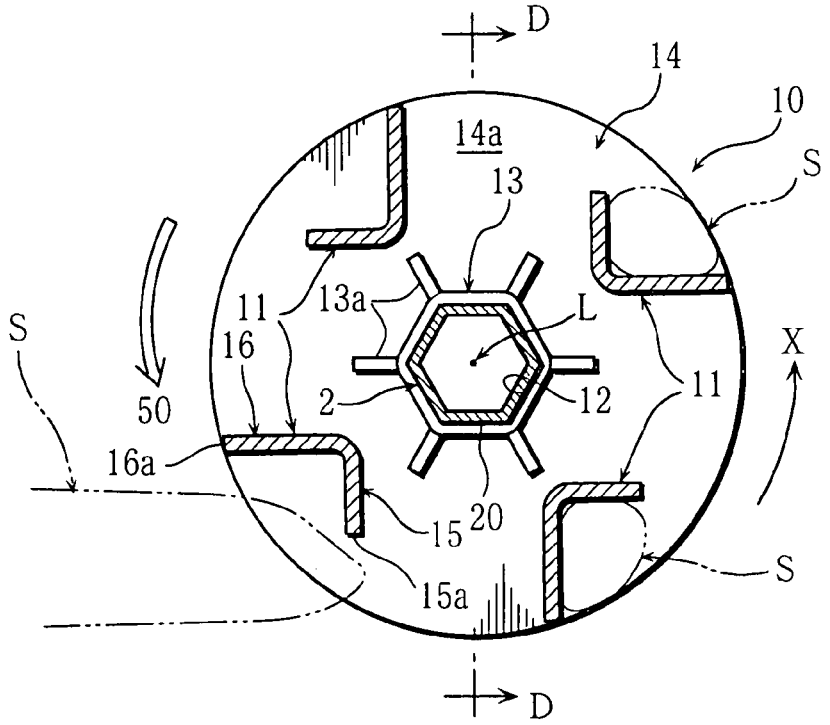
FIG. 6 is a cross-sectional view at C-C line of FIG. 3.
Figure 7:
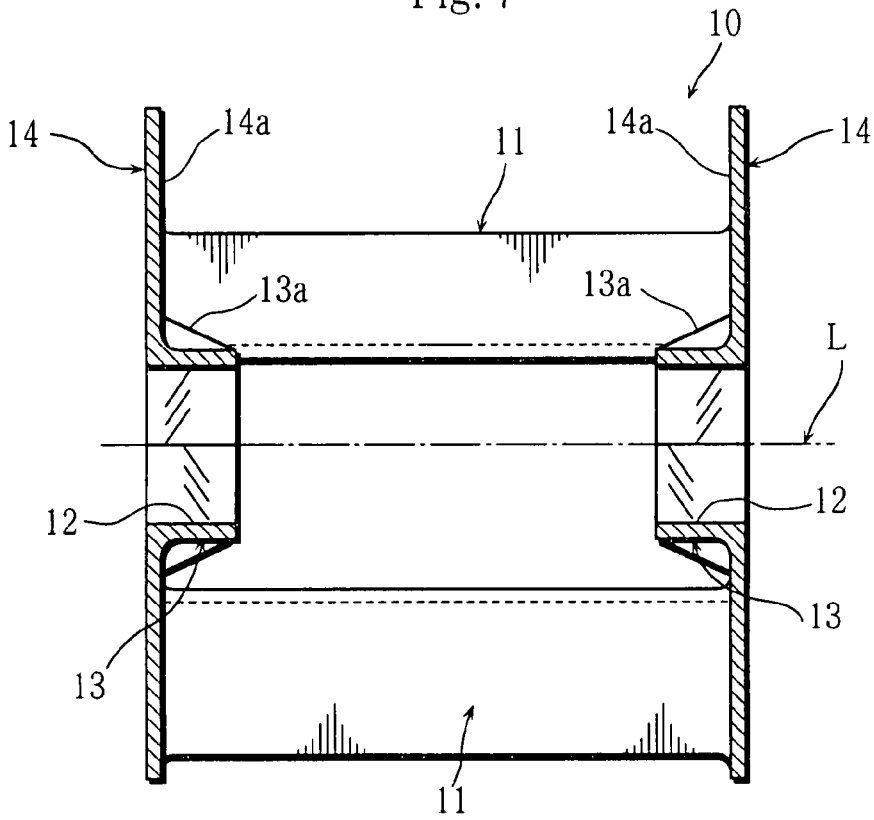
FIG. 7 is a cross-sectional view at D-D line of FIG. 6.

As shown in FIG. 1 through FIG. 3, an embodiment of snow-plowing apparatus relating to the present invention is provided with a snow-removing member 4 attached to a hand-pushed mower 40 for mowing grass instead of a mowing blade.

In the hand-pushed mower 40, an engine 6 and a wheel 7 are attached to a frame 8, rotational driving force of the engine 6 is transmitted to an end 5*a* of a holding rod 5 extended from the engine 6 forward and downward, and a rotation transmitting portion 9, to which a mowing blade is detachably attached, is provided. The rotation transmitting portion 9 has a gear case 18 disposed on the end 5*a* of the holding rod 5, a gear in the gear case 18 is connected to the engine 6 with a driving shaft disposed within the holding rod 5 as to freely rotate, and a rotation shaft portion 19 is protruding from an attachment disc portion 17 of the gear case 18. And, a mark 42 represents a spherical blade height adjuster attached to the middle of the holding rod 5 to keep a certain height of the mowing blade.

In case that the apparatus is used as the hand-pushed mower 40 for mowing grass, a rotational axis of the rotation shaft portion 19 is directed approximately vertical and the mowing blade is attached (not shown in Figures). FIG. 1 shows a state in which the mowing blade is detached from the rotation transmitting portion 9, the rotational axis of the rotation shaft portion 19 is set to be in a horizontal axis L direction, and the snow-removing member 4 is attached to the rotation transmitting portion 9.

Next, the snow-removing member 4 is described. The snow-removing member 4 is provided with a shaft member 2 attached to the rotation shaft portion 19 of the rotation transmitting portion 9 to rotate around the horizontal axis L, a snowplow rotating body 1 rotated around the horizontal axis L through the rotation transmitting portion 9 (mounted onto the shaft member 2) to plow the snow, and a housing member 3 attached to the end 5*a* of the holding rod 5 and disposed near the snowplow rotating body 1 on the rear side to guide the plowed snow as to be thrown away upward.

In FIGS. 3 through 6 and FIG. 11, the shaft member 2 has a pipe member 21 of equilateral hexagonal cylinder, an attachment end member 22 fit to an end 21*a* of the pipe member 21 and having a female screw hole 22*a* to which the rotation shaft portion 19 of the rotation transmitting portion 9 is screwed, and a shaft end member 23 fit to another end 21*b* of the pipe member 21 and having a shaft portion 23*a* protruding in a longitudinal direction (the axis L direction). And, an insertion hole 24 is formed through the end 21*b* of the pipe member 21 and the shaft end member 23 in a diameter direction, the rotating body 1 is prevented from moving in the axis L direction by insertion of a sheer prevention pin 25 into the insertion hole 24 after the snowplow rotating body 1 is mounted to the shaft member 2 (refer to FIG. 3). A rotating direction 50 of the rotating body 1 and the shaft member 2 is forward direction and anticlockwise when observed from the left side in the axis L direction.

In FIG. 1 and FIGS. 3 through 7, the snowplow rotating body 1 is composed of three short rotating bodies 10 which unitedly rotate with the shaft member 2 around the horizontal axis L. In other words, the snowplow rotating body 1 is divided into the three short rotating bodies 10 along the axis L direction.

Each of the short rotating bodies 10 has disc portions 14 disposed parallel with a predetermined interval and having insertion holes 12 in the center, short cylinder portions 13 of equilateral hexagonal cylinder bent inward from the insertion holes 12 of the disc portions 14, and four snow-plowing blades 11 unitedly formed with inner faces 14*a* of the pair of disc portions 14 and disposed in a peripheral direction X with a predetermined pitch. The insertion hole 12 is formed into an equilateral hexagon as to be mounted to the shaft member 2 without gaps. A center angle $\theta_{11}$ of equal distribution of the snow-plowing blades 11, 60° in Figures, and a replacement pitch angle $\theta_{12}$ of insertion of the shaft member 2 into the insertion hole 12 of the short rotating body 10, 90° in Figures, are set to be different and be in mutual relationship of multiplication by integer.

Each snow-plowing blade 11 has an L-shaped cross-sectional configuration made by bending a band plate and composed of a (front) band plate portion 15 on the front side in the rotating direction 50 and another (rear) band plate portion 16 on the rear side distinguished by the bend. The band plate portion 15 is shorter than the band plate portion 16, and the band plate portions 15 and 16 are disposed as to open toward a radius direction R. And, an end edge portion 15*a* of the band plate portion 15 is apart from a peripheral edge of the disc portion 14 with a predetermined interval, and another end edge portion 16*a* of the band plate portion 16 is extended as to contact the peripheral edge of the disc portion 14. With this construction, the band plate portion 16 on the rear side plows the snow S (refer to FIG. 6) just after the band plate portion 15 on the front side passes without plowing the snow S, and each of the snow-plowing blades 11 certainly catches the snow S. And, plural ribs 13*a* are formed from the periphery of the short cylinder portion 13 to the inner face 14*a* of the disc portion 14 with a predetermined pitch to make the construction of the short rotating body 10 firm.

Then, the three short rotating bodies 10 are mounted to the shaft member 2 as the disc portions 14 are tightly fit each other, and the positions of the snow-plowing blades 11 of the three short rotating bodies 10 are dislocated for 120° in the peripheral direction X one another (refer to FIGS. 3 through 6).

Figure 8:
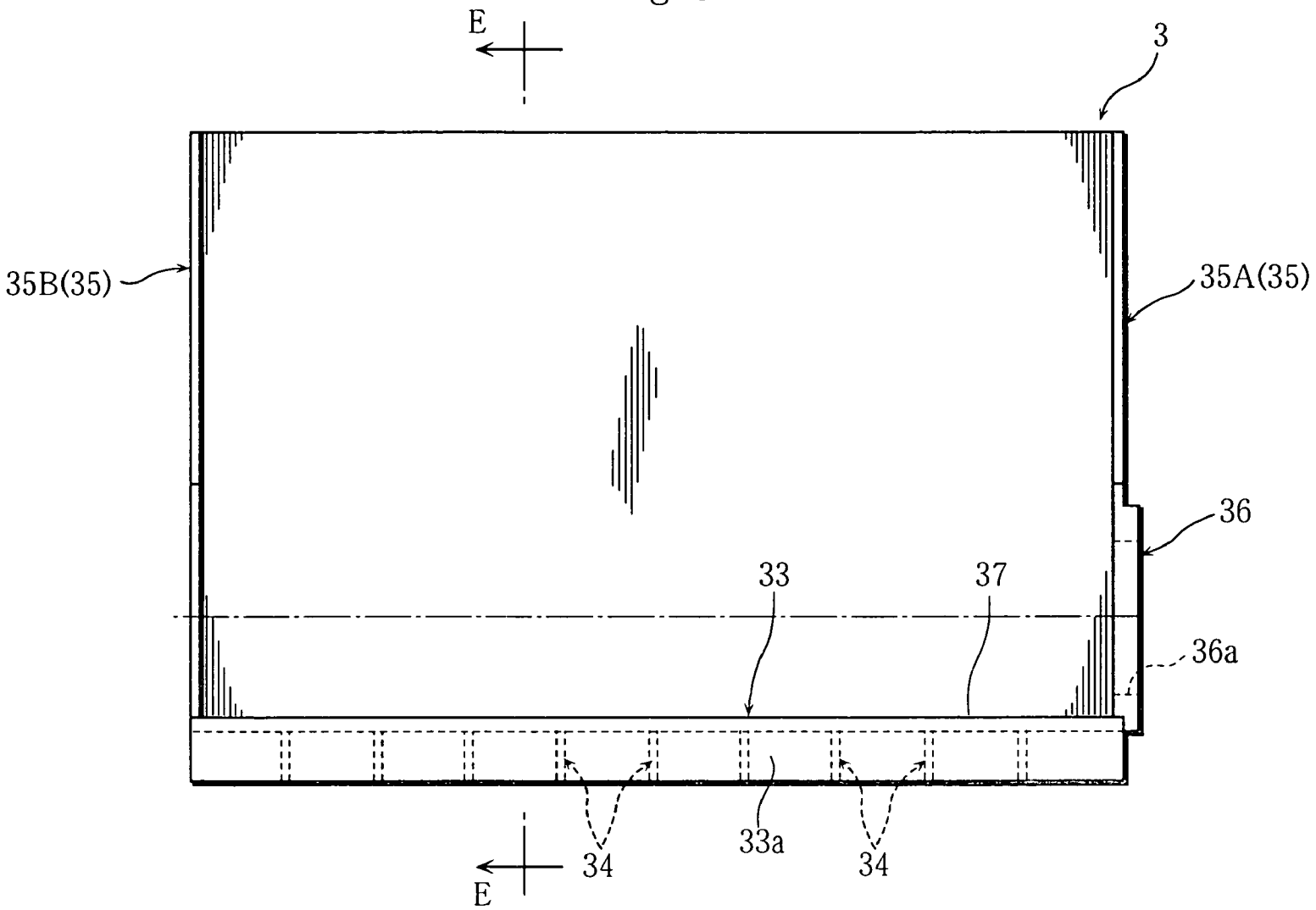
FIG. 8 is a front view showing a housing member.
Figure 9:
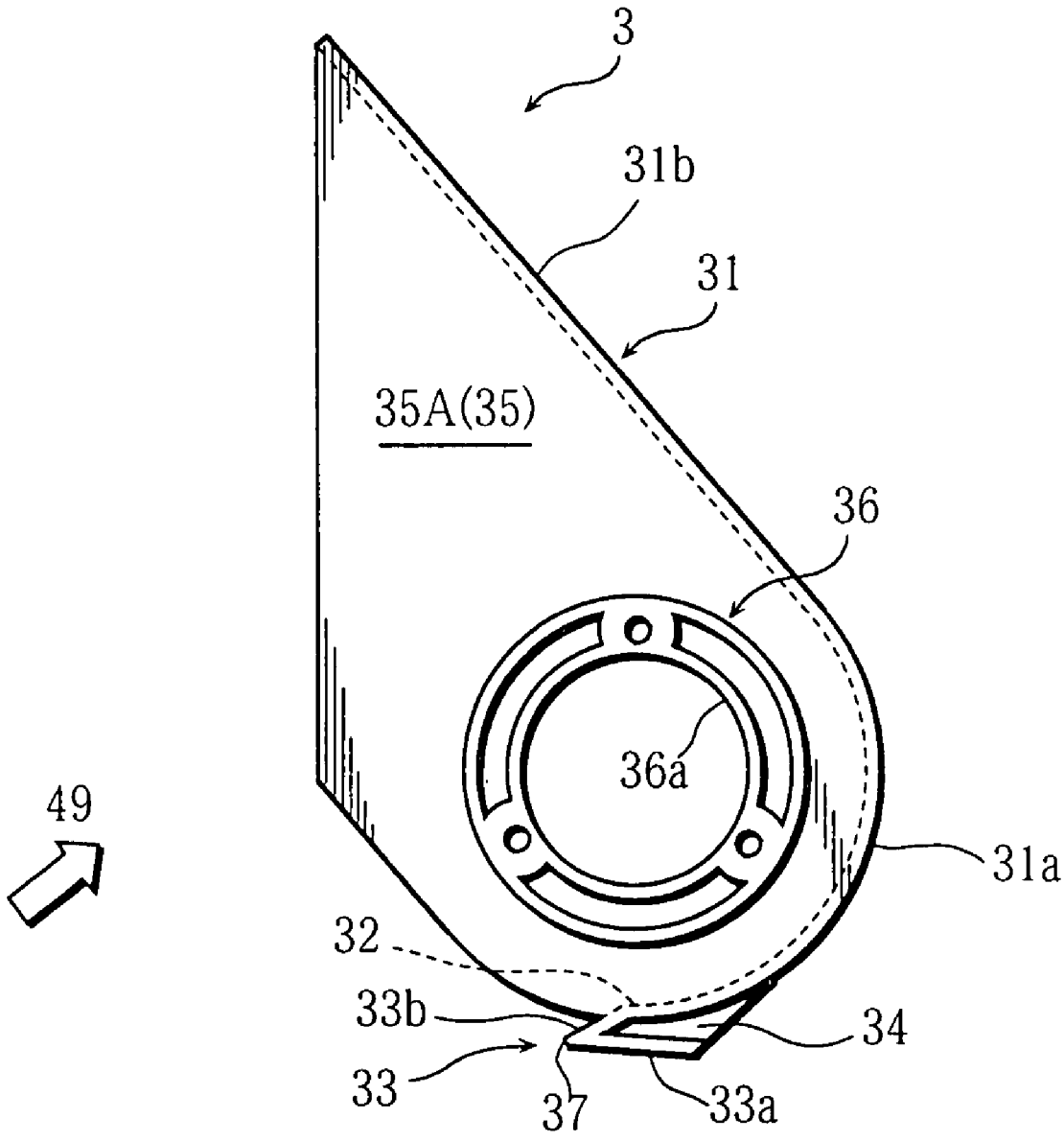
FIG. 9 is a side view showing the housing member.
Figure 10:
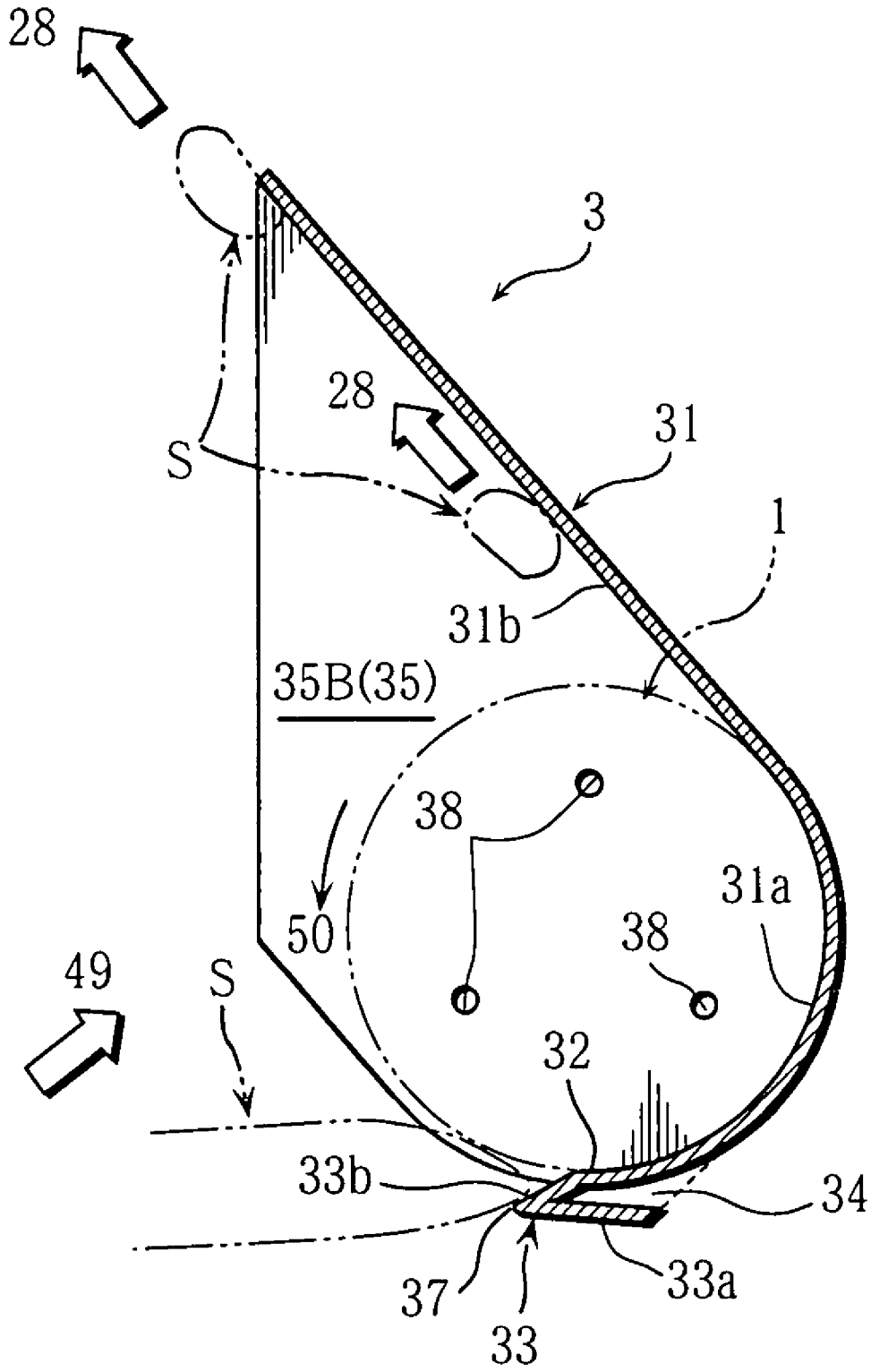
FIG. 10 is a cross-sectional view at E-E line of FIG. 8.
Figure 11:
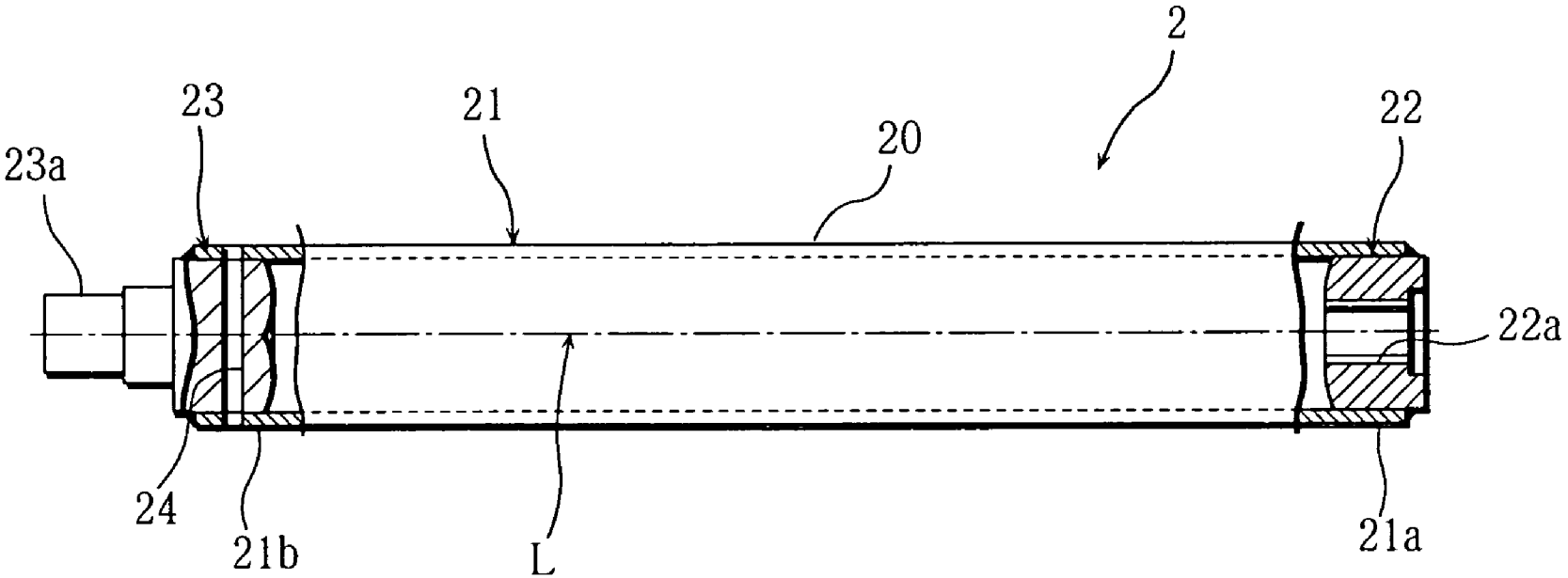
FIG. 11 is a side view with partial cross section showing a shaft member.

Next, as shown in FIGS. 8 through 10, the housing member 3 has a snow-shooting wall portion 31 approximately forward-and-upward-inclined J-shaped in cross section to guide the snow upward, side wall portions 35 of which rear side portions are unitedly formed with side portions of the snow-shooting wall portion 31, and a snow-shoveling portion 33 unitedly formed with a lower end edge 32 of the snow-shooting wall portion 31. The snow-shooting wall portion 31 has a forward-and-upward-inclined flat plate portion 31*b* and a curved plate portion 31*a* unitedly extending downward from a lower end of the flat plate portion 31*b*. A side wall portion 35A, one (on the left side in the embodiment) of the pair of the side wall portions 35 has a fixed ring portion 36 having a (circular) opening portion 36*a* on a lower portion to which the attachment disc portion 17 of the gear case 18 is fixed with a bolt and the rotation shaft portion 19 is inserted. In the fixed ring portion 36, plural female screw holes for screwing bolts are formed (3 female screw holes in ring with a predetermined pitch, for example) around the opening portion 36*a*. And, plural bolt insertion holes 38 (3 bolt insertion holes in ring with a predetermined pitch, for example) to fix a bearing member 46 described below (refer to FIG. 3 and FIG. 12) are formed on a lower portion of another side wall portion 35B (on the right side).

And, the snow-shoveling portion 33 has a shoveling portion 33*b* of band plate protruding forward unitedly with a lower end edge 32 of the snow-shooting wall portion 31, and a bottom portion 33*a* of band plate formed horizontal unitedly with a front end edge of the shoveling portion 33*b* by bending backward. The shoveling portion 33*b* and the front end edge of the bottom portion 33*a* form a shoveling edge portion 37 of acute angle in cross section. And, plural reinforcing ribs 34 of thin wall, connecting an upper face of the bottom portion 33*a*, a rear face of the shoveling portion 33*b*, and a lower face of the snow-shooting wall portion 31 unitedly, are disposed with a predetermined pitch in lateral direction to make the snow-shoveling portion 33 firm. And, a front side portion of each of the side wall portions 35 is formed vertical in an upper part and formed inclined backward and downward in a lower part (refer to FIG. 9 and FIG. 10).

The housing member 3 shown in FIG. 3 and FIG. 8 is shown in a direction (of an arrow 49 in FIGS. 9 and 10) at right angles with the snow-shooting wall portion 31.

Figure 12:
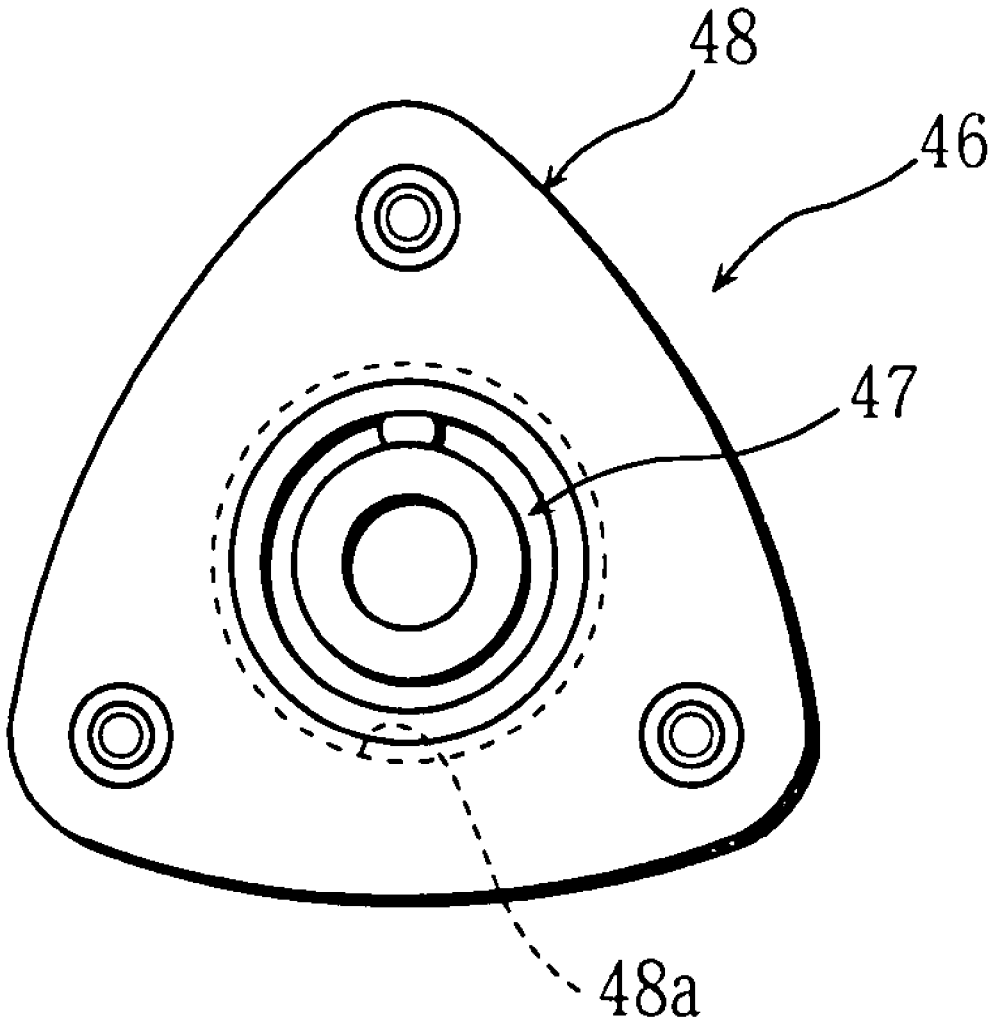
FIG. 12 is a front view showing a bearing member.

Next, in FIG. 3 and FIG. 12, the snow-removing member 4 has a bearing member 46 attached to an inner face side of the side wall portion 35B of the housing member 3 and holding the shaft portion 23*a* of the shaft member 2 as to freely rotate. Concretely, the bearing member 46 has a (radial) bearing 47 having an inner ring to which the shaft portion 23*a* of the shaft member 2 is fit, and a bearing main body 48 having a hole 48*a* to which an outer ring of the bearing 47 is fit. The bearing main body has an approximately triangular configuration, and female screw holes corresponding to the bolt insertion holes 38 on the right side wall portion 35B of the housing member 3. And, the bearing main body 48 is attached to the inner face of the side wall portion 35B with bolts. The shaft member 2 smoothly rotates without staggering of the axis and snow plowing work is smoothly conducted because one side of the shaft member 2 is held by the bearing member 46 as to freely rotate.

And, in FIG. 1 and FIG. 2, a mark 26 represents a fixing rod portion of which end 26*a* and another end 26*b* are detachably attached to the holding rod 5 and rear portion of the housing member 3 respectively to fix the direction of the snow-removing member 4. The end 26*a* is, for example, composed of an attachment portion opened and closed by a hinge to surround the holding rod 5 and fix with screws, and the other end 26*b* is composed of an attachment piece attached to and detached from the rear face of the housing member 3 with screws.

Figure 13:
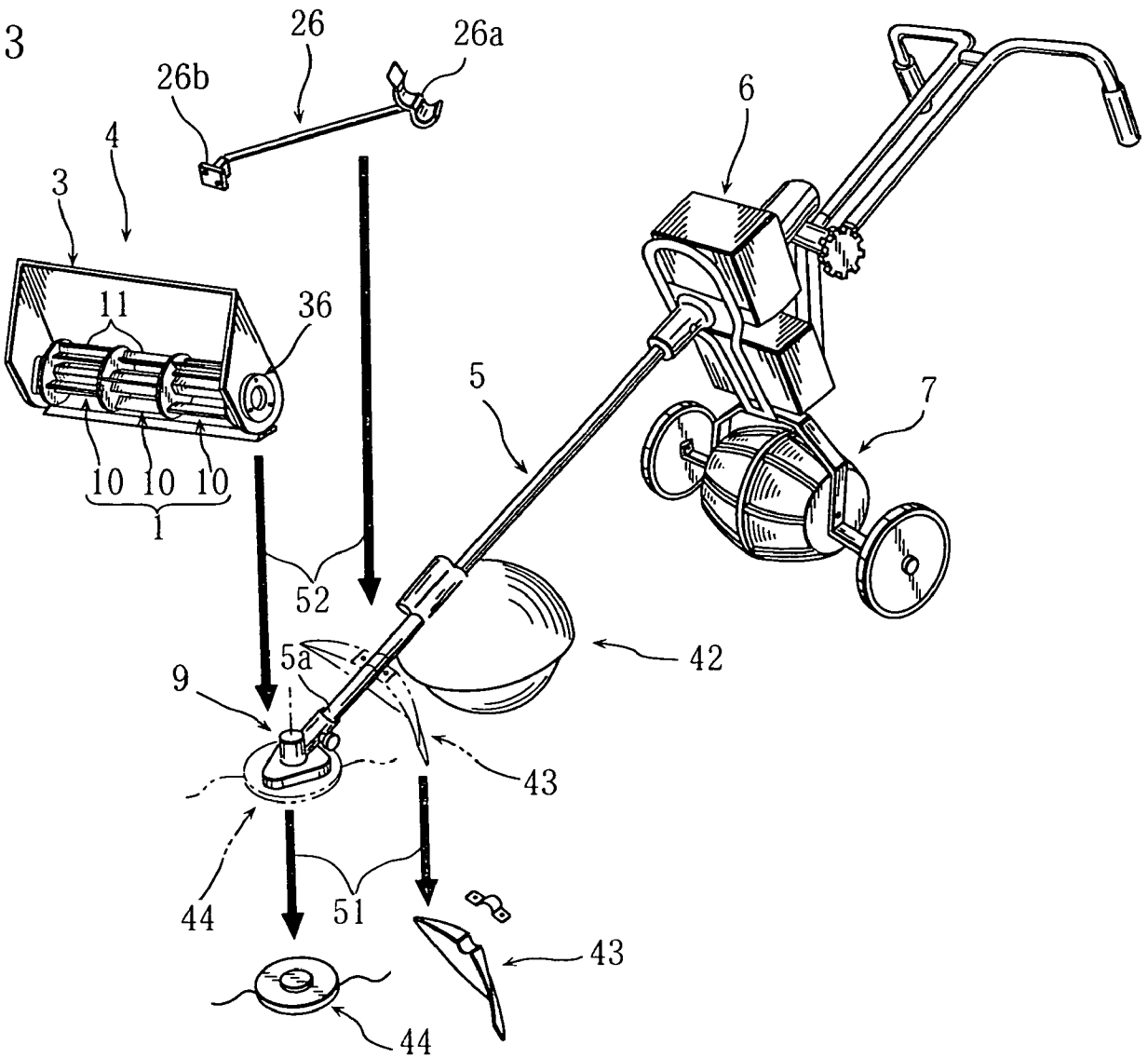
FIG. 13 is an explanatory perspective view showing another embodiment of the snow-plowing apparatus relating to the present invention.

FIG. 13 shows another embodiment of the snow-plowing apparatus relating to the present invention. The wheel 7, different from that of FIG. 1, has a small hollow barrel (shell construction) formed by blow molding of similar size to the blade height adjuster 42. The wheel 7 of the mower 40 in FIG. 1 is formed into a tire having diameter larger than the blade height adjuster 42, and, although not shown in Figures, anti-skid concavo-convex may be formed on the tread. And, a pair of auxiliary wheels are disposed on the both sides of the wheel 7 in both apparatuses in FIG. 1 and FIG. 13.

And, in case that the hand-pushed mower 40 is used for mowing grass in FIG. 13, the blade height adjuster 42 and a guard member 43 are attached to the holding rod 5, and a mowing blade 44 is attached to a rotation shaft portion (not shown in FIG. 13) of the rotation transmitting portion 9 directed vertical (the state shown with two-dot broken lines). The guard member 43, detachably attached to the holding rod 5 in front of the blade height adjuster 42, prevents grass from jumping toward the user.

Next, in case that the mower 40 is used for snow-plowing, the guard member 43 and the mowing blade 44 are removed from the holding rod 5 and the rotation transmitting portion 9 (refer to arrows 51), the rotation shaft portion of the rotation transmitting portion 9 is directed horizontal, and the fixing rod portion 26 and the snow-removing member 4 are attached to the rotation transmitting portion 9 (refer to arrows 52).

In the hand-pushed mower 40 in FIG. 1, the guard member and the mowing blade are also attached to the holding rod 5 and the rotation transmitting portion 9 when used for mowing grass (not shown in Figures), replacement is conducted in similar manner to the above-described process in FIG. 13 when used for snow-plowing.

Then, when the engine 6 of the hand-pushed mower 40 is started in FIGS. 1 through 6 and FIG. 10, the shaft member 2 and the snowplow rotating body 1, connected to the rotation shaft portion 19 of the rotation transmitting portion 9, are rotated forward around the horizontal axis L as shown with the arrow 50. And, when the user holds the handle 41 and move the mower 40 forward, the shoveling edge portion 37 of the snow-shoveling portion 33 shovels the snow S on the ground, the shoveled snow S slides up along the forward-inclined shoveling portion 33*b*, and the snow S is smoothly sent to the snowplow rotating body 1.

And, as described above, the three short rotating bodies 10 forming the snowplow rotating body 1 unitedly rotate keeping the state that the snow-plowing blades 11 of each short rotating body 10 are dislocated for 120° in the peripheral direction X each other (refer to FIG. 4 through FIG. 6), and the snow-plowing blades 11 of all of the short rotating bodies 10 do not plow the snow S simultaneously because timing of plowing the snow S by each snow-plowing blade 11 differs for a 120° cycle in the short rotating bodies 10 respectively. Therefore, the torque that the shaft member 2 and the short rotating bodies 10 receive in plowing the snow S is about one third of the torque when the snow-plowing blades 11 plow the snow S for the whole length in the axis direction, and stress on the engine 6 is greatly reduced thereby.

And, being different from an electric snowplow, plowing work is possible in a place where an electric cord is not available. Further, the snow-removing member 4 does not need a gearbox and number of parts is reduced because rotation number of the snowplow rotating body 1 can be changed by changing the rotation speed of the engine.

And, the snow S, shoveled by the snow-plowing blade 11, is held on the snow-plowing blade 11 by the curved plate portion 31*a* when the snow-plowing blade 11 is on a position corresponding to the curved plate portion 31*a* of the snow-shooting wall portion 31 of the housing member 3, and the snow S, sliding along the front face of the flat plate portion 31*b* of the snow-shooting wall portion 31, is thrown in the forward-and-upward-inclined direction when the snow-plowing blade 11 reaches near a top portion (refer to an arrow 28 in FIG. 10). And, the snow is not scattered on both sides of the apparatus by guard of the both side wall portions 35. As described above, the snow is guided along the forward-and-upward-inclined direction and thrown away by the housing member 3.

The snow-removing member 4, although attached to be directed slightly to the left side in FIG. 1 and FIG. 2, can be modified to be directed slightly to the right side or to face the front side. And, the snow-removing member 4, although composed as the rotation transmitting portion 9 is attached to the left side wall portion 35A of the housing member 3, may be composed as the rotation transmitting portion 9 is attached to the right side wall portion 35B as to make the whole construction of the snow-removing member 4 reverse (not shown in Figures).

And, the snowplow rotating body 1, although composed of three short rotating bodies 10 in the present invention, may be composed 4 or more short rotating bodies 10 as to correspond to the length of the snowplow rotating body 1.

And, although the mowing blade of the hand-pushed mower 40 is replaced with the snow-removing member 4 in the present invention, a hand-pushed snowplow having the snow-removing member 4 as in the present invention may be produced. That is to say, in this snowplow, the engine 6 and the wheel 7 are attached to the frame 8, and the snow-removing member 4 is attached to the end 5*a* of the holding rod 5 extended from the engine 6 in a forward-and-downward-inclining direction And, in FIG. 1 and FIG. 13, the snow is efficiently plowed with a broad width like sweeping of a broom because the end 5*a* of the holding rod 5 can be swung broadly and lightly not only forward and backward but also left and right because of the blade height adjuster 42 attached to the mower 40.

As described above, one unit of the hand-pushed mower 40 can be used for grass mowing in summer and for snow plowing in winter by replacement of the mowing blade attached to the rotation transmitting portion 9 with the snow-removing member 4, and the hand-pushed machine having the engine 6 and the wheel 7 is effectively used for many purposes because the snow-plowing apparatus relating to the present invention has a construction in which the snow-removing member 4, detachably attached to the end 5*a* of the holding rod 5, extended in forward-and-downward-inclined direction, of the hand-pushed mower 40 having the engine 6, the wheel 7 attached to the frame 8, and the detachable rotation transmitting portion 9 to which rotational driving force of the engine 6' is transmitted and the mowing blade is detachably attached, is provided, and the snow-removing member 4 is provided with the snowplow rotating body 1 rotated around the horizontal axis L by the rotation transmitting portion 9 for plowing and throwing snow. And, changing work is convenient without much labor because the purpose is changed only by attachment and removal of the mowing blade and the snow-removing member 4 on the rotation transmitting portion 9. And, purchasing cost can be reduced because machines specialized in mowing and snowplow are not necessary to buy.

And, the apparatus composed of the engine 6 and the wheel 7 can be multi-purpose and effectively used for grass mowing in summer and for snow plowing in winter by replacement of the mowing blade attached to the rotation transmitting portion 9 with the snow-removing member 4 because the snow-plowing apparatus relating to the present invention has a construction in which the engine 6 and the wheel 7 are attached to the frame 8, the snow-removing member 4, detachably attached to the end 5*a* of the holding rod 5 extended from the engine 6 in forward-and-downward-inclined direction, and the snow-removing member 4 is provided with the snowplow rotating body 1 rotated around the horizontal axis L for plowing and throwing snow by the rotation transmitting portion 9, disposed on the end 5*a* of the holding rod 5, to which rotational driving force of the engine 6 is transmitted. And, changing work is convenient without much labor because the purpose is changed only by attachment and removal of the mowing blade and the snow-removing member 4 on the rotation transmitting portion 9. And, purchasing cost can be reduced because machines specialized in mowing and snowplow are not necessary to buy.

And, all of the snow-plowing blades 11 of the short rotating bodies 10 do not simultaneously plow the snow S for the difference of timing that the snow-plowing blades 11 of the short rotating bodies 10 approach the snow S because the snow-removing member 4 is provided with the shaft member 2 attached to the rotation transmitting portion 9 and rotated around the horizontal axis L, and the housing member 3 attached to the end 5*a* of the holding rod 5 and disposed near the rear side of the snowplow rotating body 1 to lead the snow plowed by the snowplow rotating body 1 upward, the snowplow rotating body 1 is composed of plural short rotating bodies 10 having the insertion hole 12 to mount to the shaft member 2 and unitedly rotated around the horizontal axis L, and each of the short rotating bodies 10 has the plural snow-plowing blades 11 disposed with a predetermined pitch in the peripheral direction X, and the plural short rotating bodies 10 are mounted to the shaft member 2 to compose the snowplow rotating body 1 as the plural snow-plowing blades 11 are dislocated each other in the peripheral direction X. Therefore, when the short rotating body 10 is divided into three units, for example, the torque which the rotation transmitting portion 9 receives when the snow S is plowed is about ⅓ of a case in which the snow-plowing blades 11 plow the snow S simultaneously with the whole length in the axis direction, and stress on the engine 6 is greatly reduced. Consequently, the snowplow rotating body 1 rotates smoothly, the snow plowing is efficiently conducted, and defects of the engine 6 are reduced.

To make the whole snowplow rotating body 1 as one unit, the mold causes high cost and it is quite difficult to make the mold with high accuracy. The cost of the mold is greatly reduced with high accuracy by dividing the snowplow rotating body 1 into the plural short rotating bodies 10.

And, snow plowing is smoothly conducted because the snow shoveled by the snow-plowing blades 11 is guided forward and upward and thrown away.

The plural short rotating bodies 10 having the same configuration (provided with the snow-plowing blades 11 with the same distribution) can be mounted on the shaft member 2 as phase of the snow-plowing blades 11 of each short rotating body 10 dislocate in the peripheral direction X because the shaft member 2 has the peripheral face 20 of equilateral hexagon in cross section, and the insertion hole 12 of the short rotating body 10 is formed to be equilateral hexagon to be mounted to the shaft member 2 without gaps. Therefore, for example, three short rotating bodies 10 can be mounted to the shaft member 2 to be dislocate phases each other for 120°. And, production cost can be reduced because a short rotating body 10 having different distribution of the snow-plowing blades 11 is not necessary.

When the mower 40 proceeds, the snow-shoveling portion 33 bites into the snow accumulated on the ground, and the snow is smoothly sent to the snowplow rotating body 1 to plow the snow efficiently because the housing member 3 has the snow-shooting wall portion 31 approximately upward-and-forward-inclined J-shaped in cross section to guide the snow upward, and the snow-shoveling portion 33 formed unitedly with the snow-shooting wall portion 31 along the lower end edge 32 of the snow-shooting wall portion 31.

The snow can be thrown away in the upward-and-forward-inclined direction to smoothly conduct the snow plowing because the snow shoveled by the snow-plowing blades 11 is guided along the front face of the snow-shooting wall portion 31 of the housing member 3 along with the rotation of the short rotating bodies 10.

And, the snow-shooting wall portion 31 and the snow-shoveling portion 33 unitedly formed within the housing member 3 do not cause much labor in comparison with a case that separated members are connected with bolts, and have a strong construction without separation by loosening of the bolts in use.

While preferred embodiments of the present invention have been described in this specification, it is to be understood that the invention is illustrative and not restrictive, because various changes are possible within the spirit and indispensable features.

What is claimed is:

1. A snow-plowing apparatus comprising:

a snow-removing member, detachably attached to an end of a holding rod, extended in forward-and-downward direction, of a hand-pushed mower including an engine, a wheel attached to a frame, and a rotation transmitting portion including a gear case and a rotation shaft portion, and being detachably attached to the snow-removing member through an attached disc portion, to which rotational driving force of the engine is transmitted and a mowing blade is detachably attached;

wherein:

the snow-removing member includes a snowplow rotating body rotated around a horizontal axis by the rotation transmitting portion for plowing and throwing snow, and the rotation shaft portion of the rotation transmitting portion is directed vertically when the mowing blade is attached, and directed horizontally when the snow-removing member is attached;

the snow-removing member includes a shaft member that is attached to the rotation transmitting portion and rotated around the horizontal axis, and a housing member attached to the end of the holding rod and disposed near a rear side of the snowplow rotating body to lead the snow plowed by the snowplow rotating body upward;

the snowplow rotating body is divided into plural short rotating bodies along the horizontal axis of the rotating body, each rotating body including a respective insertion hole to mount to the shaft member and thereby to rotate unitedly around the horizontal axis, and each of the short rotating bodies comprises respective plural snow-plowing blades disposed with a predetermined pitch in a peripheral direction; and wherein the plural short rotating bodies are mounted to the shaft member to compose the snowplow rotating body with the plural snow-plowing blades dislocated relative to each other in the peripheral direction around the horizontal axis;

whereby torque on the shaft member is reduced.

2. The snow-plowing apparatus as set forth in claim 1, wherein the shaft member has a peripheral face shaped as an equilateral hexagon in cross section, and wherein the insertion hole of the short rotating body is shaped as the equilateral hexagon to be mounted to the shaft member without gaps.

3. The snow-plowing apparatus as set forth in claim 2, wherein the housing member has a snow-shooting wall portion approximating an upward-and-forward-inclined J-shape in cross section to guide the snow upward, and a snow-shoveling portion formed unitedly with the snow-shooting wall portion along a lower end edge of the snow-shooting wall portion.

4. The snow-plowing apparatus as set forth in claim 1, wherein the short rotating bodies number three, wherein the shaft member has a peripheral face shaped as an equilateral hexagon in cross section, and wherein the insertion hole of the short rotating body is shaped as the equilateral hexagon to be mounted to the shaft member without gaps, and wherein the snow-plowing blades of the short rotating bodies are dislocated by 120° relative to one another in the peripheral direction.

5. The snow-plowing apparatus as set forth in claim 4, wherein each of the short rotating bodies comprises four of the snow-plowing blades and the snow-plowing blades are equally-spaced at the predetermined pitch.

6. The snow-plowing apparatus as set forth in claim 5, wherein a center angle of equal distribution of the snow-plowing blades and a replacement pitch angle of insertion of the shaft member into the insertion hole of the short rotating body are set to be different and in mutual relationship of multiplication by an integer.

7. The snow-plowing apparatus as set forth in claim 1, wherein a center angle of equal distribution of the snow-plowing blades and a replacement pitch angle of insertion of the shaft member into the insertion hole of the short rotating body are set to be different and in mutual relationship of multiplication by an integer.

8. The snow-plowing apparatus as set forth in claim 1, wherein the short rotating bodies have a same configuration.

* * * * *